US008199948B2

(12) United States Patent
Theverapperuma

(10) Patent No.: US 8,199,948 B2
(45) Date of Patent: Jun. 12, 2012

(54) ENTRAINMENT AVOIDANCE WITH POLE STABILIZATION

(75) Inventor: Lalin Theverapperuma, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1258 days.

(21) Appl. No.: 11/877,606

(22) Filed: Oct. 23, 2007

(65) Prior Publication Data

US 2008/0095389 A1 Apr. 24, 2008

Related U.S. Application Data

(60) Provisional application No. 60/862,545, filed on Oct. 23, 2006.

(51) Int. Cl.
*H04R 25/00* (2006.01)

(52) U.S. Cl. .... 381/318; 381/60; 381/71.11; 381/71.12; 381/93

(58) Field of Classification Search ..... 381/60, 381/312, 317, 318, 71.1, 71.11, 71.12, 93, 381/83

See application file for complete search history.

(56) References Cited

U.S. PATENT DOCUMENTS

| | | | |
|---|---|---|---|
| 3,601,549 | A | 8/1971 | Mitchell |
| 4,495,643 | A | 1/1985 | Orban |
| 4,731,850 | A | 3/1988 | Levitt et al. |
| 4,783,817 | A | 11/1988 | Hamada et al. |
| 4,879,749 | A | 11/1989 | Levitt et al. |
| 5,016,280 | A | 5/1991 | Engebretson et al. |
| 5,502,869 | A | 4/1996 | Smith et al. |
| 5,533,120 | A | 7/1996 | Staudacher |
| 5,619,580 | A | 4/1997 | Hansen |
| 5,621,802 | A | 4/1997 | Harjani et al. |
| 5,668,747 | A | 9/1997 | Ohashi |
| 6,072,884 | A | 6/2000 | Kates |
| 6,173,063 | B1 | 1/2001 | Melanson |
| 6,219,427 | B1 | 4/2001 | Kates et al. |
| 6,356,606 | B1 | 3/2002 | Hahm |
| 6,389,440 | B1 | 5/2002 | Lewis et al. |
| 6,434,247 | B1 | 8/2002 | Kates et al. |

(Continued)

FOREIGN PATENT DOCUMENTS

EP 1367857 A1 12/2003

(Continued)

OTHER PUBLICATIONS

"International Application Serial No. PCT/US2007/022548, International Preliminary Report on Patentability mailed May 7, 2009", 8 pgs.

(Continued)

*Primary Examiner* — Kenneth Parker
*Assistant Examiner* — Yu Chen
(74) *Attorney, Agent, or Firm* — Schwegman, Lundberg & Woessner, P.A.

(57) ABSTRACT

A system of signal processing an input signal in a hearing assistance device to avoid entrainment wherein the hearing assistance device including a receiver and a microphone, the method comprising using an adaptive filter to estimate an acoustic feedback path from the receiver to the microphone, generating one or more estimated future pole positions of a transfer function of the adaptive filter, analyzing stability of the one or more estimated pole positions for an indication of entrainment and adjusting the adaptation of the adaptive filter based on the stability.

9 Claims, 5 Drawing Sheets

U.S. PATENT DOCUMENTS

| | | | | |
|---|---|---|---|---|
| 6,480,610 | B1 | 11/2002 | Fang et al. | |
| 6,498,858 | B2 * | 12/2002 | Kates | 381/318 |
| 6,552,446 | B1 | 4/2003 | Lomba et al. | |
| 7,058,182 | B2 | 6/2006 | Kates | |
| 7,065,486 | B1 | 6/2006 | Thyssen | |
| 7,519,193 | B2 | 4/2009 | Fretz | |
| 7,809,150 | B2 | 10/2010 | Natarajan et al. | |
| 2003/0026442 | A1 | 2/2003 | Fang et al. | |
| 2003/0031314 | A1 | 2/2003 | Tanrikulu et al. | |
| 2003/0185411 | A1 | 10/2003 | Atlas et al. | |
| 2004/0125973 | A1 | 7/2004 | Fang et al. | |
| 2005/0036632 | A1 | 2/2005 | Natarajan et al. | |
| 2005/0047620 | A1 | 3/2005 | Fretz | |
| 2006/0140429 | A1 * | 6/2006 | Klinkby et al. | 381/317 |
| 2007/0223755 | A1 | 9/2007 | Salvetti et al. | |
| 2008/0095388 | A1 | 4/2008 | Theverapperuma | |
| 2008/0130926 | A1 | 6/2008 | Theverapperuma | |
| 2008/0130927 | A1 | 6/2008 | Theverapperuma et al. | |
| 2009/0175474 | A1 | 7/2009 | Salvetti et al. | |
| 2011/0091049 | A1 | 4/2011 | Salvetti et al. | |
| 2011/0116667 | A1 | 5/2011 | Natarajan et al. | |

FOREIGN PATENT DOCUMENTS

| | | | |
|---|---|---|---|
| EP | 1718110 | A1 | 2/2006 |
| WO | WO-0106746 | A2 | 1/2001 |
| WO | WO-0106812 | A1 | 1/2001 |
| WO | WO-0110170 | A2 | 2/2001 |
| WO | WO-2004105430 | A1 | 12/2004 |
| WO | WO-2008051569 | A2 | 5/2008 |
| WO | WO-2008051569 | A3 | 5/2008 |
| WO | WO-2008051570 | A1 | 5/2008 |
| WO | WO-2008051571 | A1 | 5/2008 |

OTHER PUBLICATIONS

"International Application Serial No. PCT/US2007/022548, Search Report mailed Jun. 3, 2008", 7 pgs.

"International Application Serial No. PCT/US2007/022548, Written Opinion mailed Jun. 3, 2008", 8 pgs.

Lalin, S. T, et al., "Adaptive Feedback Canceller: Entrainment", *Digital Signal Processing Workshop*, 4th IEEE, PI, (Sep. 1, 2006), 245-250.

Lalin, S. T, et al., "Continuous Adaptive Feedback Canceller Dynamics", *Circuits and Systems*, 49th IEEE International Midwes T Symposium on, IEEE, PI, (Aug. 1, 2006), 605-609.

Proakis, J. G, et al., "Digital Signal Processing", *Prentice-Hall, Inc.*, XP002481168, (1996), 213-214-p. 536.

"Advance Adaptive Feedback Cancellation", *IntriCon: Technology White Paper*, [Online]. Retrieved from the Internet: <URL: http://www.intricondownloads.com/D1/techdemo/WP_Advanced_AFC_rev101006.pdf>, (Oct. 10, 2005), 3 pg.

"Entrainment (Physics)", [Online]. Retrieved from the Internet: <URL: http://en.wikipedia.org/w/index.php?title=Entrainment_(physics)&printable=yes>, (Jun. 18, 2009), 2 pgs.

"Inspiria Ultimate—GA3285", [Online]. Retrieved from the Internet: <URL: http://www.sounddesigntechnologies.com/products_InspiriaUltimate.php>, (Jun. 18, 2009), 4 pgs.

"U.S. Appl. No. 10/857,599, Final Office Action mailed Jun. 11, 2009", 7 pgs.

"U.S. Appl. No. 10/857,599, Final Office Action Mailed Jul. 24, 2008", 9 pgs.

"U.S. Appl. No. 10/857,599, Non-Final Office Action mailed Jan. 26, 2010", 8 pgs.

"U.S. Appl. No. 10/857,599, Non-Final Office Action mailed Dec. 26, 2007", 8 pgs.

"U.S. Appl. No. 10/857,599, Non-Final Office Action mailed Dec. 31, 2008", 6 pgs.

"U.S. Appl. No. 10/857,599, Notice of Allowance mailed Jul. 26, 2010", 10 pgs.

"U.S. Appl. No. 10/857,599, Response filed Apr. 26, 2010 to Non Final Office Action mailed Jan. 26, 2010", 8 pgs.

"U.S. Appl. No. 10/857,599, Response filed Apr. 28, 2008 to Non-Final Office Action mailed Dec. 26, 2007", 7 pgs.

"U.S. Appl. No. 10/857,599, Response filed Apr. 30, 2009 to Non-Final Office Action mailed Dec. 31, 2008", 7 pgs.

"U.S. Appl. No. 10/857,599, Response filed Nov. 12, 2009 to Final Office Action mailed Jun. 11, 2009", 9 pgs.

"U.S. Appl. No. 10/857,599, Response filed Nov. 16, 2007 to Restriction Requirement dated May 21, 2007", 6 pgs.

"U.S. Appl. No. 10/857,599, Response filed Nov. 24, 2008 to Final Office Action mailed Jul. 24, 2008", 9 pgs.

"U.S. Appl. No. 10/857,599, Restriction Requirement mailed May 21, 2007", 5 pgs.

"U.S. Appl. No. 11/276,763, Decision on Pre-Appeal Brief Request mailed Feb. 15, 2011", 3 pgs.

"U.S. Appl. No. 11/276,763, Final Office Action mailed Sep. 14, 2010", 9 pgs.

"U.S. Appl. No. 11/276,763, Non-Final Office Action mailed Apr. 2, 2010", 11 pgs.

"U.S. Appl. No. 11/276,763, Notice of Allowance mailed Aug. 25, 2011", 8 pgs.

"U.S. Appl. No. 11/276,763, Pre-Appeal Brief Request filed Jan. 14, 2011", 5 pgs.

"U.S. Appl. No. 11/276,763, Response filed Jan. 11, 2010 to Restriction Requirement mailed Dec. 10, 2009", 9 pgs.

"U.S. Appl. No. 11/276,763, Response filed Jun. 15, 2011 to Final Office Action mailed Sep. 14, 2010", 10 pgs.

"U.S. Appl. No. 11/276,763, Response filed Jul. 2, 2010 to Non Final Office Action mailed Apr. 2, 2010", 15 pgs.

"U.S. Appl. No. 11/276,763, Restriction Requirement mailed Dec. 10, 2009", 6 pgs.

"U.S. Appl. No. 11/877,317, Non Final Office Action mailed Aug. 18, 2011", 16 pgs.

"U.S. Appl. No. 11/877,567, Non Final Office Action mailed Sep. 1, 2011", 17 pgs.

"European Application Serial No. 07250899.7, European Search Report mailed May 15, 2008", 7 pgs.

"European Application Serial No. 07250899.7, Office Action Mailed Jan. 15, 2009", 1 pgs.

"European Application Serial No. 07250899.7, Office Action mailed Mar. 21, 2011", 3 pgs.

"European Application Serial No. 07250899.7, response filed Sep. 5, 2011 to Office Action mailed Mar. 21, 2011", 25 pgs.

"European Application Serial No. 07250899.7, Response to Official Communication Filed Jul. 13, 2009", 17 pgs.

"European Application Serial No. 07839767.6, Office Action mailed May 5, 2011", 4 pgs.

"European Application Serial No. 07839767.6, Response filed Jun. 2, 2011 to Office Action mailed May 5, 2011", 11 pgs.

"International Application Serial No. PCT/US2007/022549, International Preliminary Report on Patentability mailed May 7, 2009", 8 pgs.

"International Application Serial No. PCT/US2007/022549, International Search Report and Written Opinion mailed Feb. 15, 2008", 12 pgs.

"International Application Serial No. PCT/US2007/022550, International Preliminary Report on Patentability mailed May 7, 2009", 8 pgs.

"International Application Serial No. PCT/US2007/022550, International Search Report and Written Opinion mailed Oct. 23, 2006", 12 pgs.

Beaufays, Francoise, "Transform-Domain Adaptive Filters: An Analytical Approach", IEEE Trans. on Signal Proc., vol. 43(2), (Feb. 1995), 422-431.

Chankawee, A., et al., "Performance improvement of acoustic feedback cancellation in hearing aids using liner prediction", Digital Signal Processing Research Laboratory(DSPRL), (Nov. 21, 2004), 116-119.

Maxwell, J. A., et al., "Reducing Acoustic Feedback in Hearing Aids", IEEE Transactions on Speech and Audio Processing, 3(4), (Jul. 1995), 304-313.

Rife, D., et al., "Transfer-Function Measurement With Maximum-Length Sequences", J. Audio Eng. Soc., 37(6), (1989), 419-444.

* cited by examiner

ENTRAINMENT AVOIDANCE WITH POLE STABILIZATION

CLAIM OF PRIORITY AND RELATED APPLICATION

This application claims the benefit under 35 U.S.C. 119(e) of U.S. Provisional Patent Application Ser. No. 60/862,545, filed Oct. 23, 2006, the entire disclosure of which is hereby incorporated by reference in its entirety.

TECHNICAL FIELD

The present subject matter relates generally to adaptive filters and in particular to method and apparatus to reduce entrainment-related artifacts for hearing assistance systems.

BACKGROUND

Digital hearing aids with an adaptive feedback canceller usually suffer from artifacts when the input audio signal to the microphone is periodic. The feedback canceller may use an adaptive technique, such as a N-LMS algorithm, that exploits the correlation between the microphone signal and the delayed receiver signal to update a feedback canceller filter to model the external acoustic feedback. A periodic input signal results in an additional correlation between the receiver and the microphone signals. The adaptive feedback canceller cannot differentiate this undesired correlation from that due to the external acoustic feedback and borrows characteristics of the periodic signal in trying to trace this undesired correlation. This results in artifacts, called entrainment artifacts, due to non-optimal feedback cancellation. The entrainment-causing periodic input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, instrumental music to name a few. These artifacts, in addition to being annoying, can result in reduced output signal quality. Thus, there is a need in the art for method and apparatus to reduce the occurrence of these artifacts and hence provide improved quality and performance.

SUMMARY

This application addresses the foregoing needs in the art and other needs not discussed herein. Method and apparatus embodiments are provided for a system to avoid entrainment of feedback cancellation filters in hearing assistance devices. Various embodiments include using an adaptive filter to measure an acoustic feedback path and monitoring the poles of the adaptive filter for indications of entrainment. Various embodiments include comparing the poles of the system transfer function to a pseudo circle of stability for the indication of entrainment of the adaptive filter. Various embodiments include suspending adaptation of the adaptive filter upon indication of entrainment.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present system may be employed in a variety of hardware devices, including hearing assistance devices. Such devices may include a signal processor or other processing hardware to perform functions. One such function is acoustic feedback cancellation using an adaptive filter. In such embodiments, the acoustic feedback cancellation filter models the acoustic feedback path from receiver to microphone of the hearing assistance system to subtract the acoustic feedback that occurs without such correction. In one embodiment, entrainment is avoided by using signal processing electronics to determine the denominator of the system transfer function and analyze the denominator of the system transfer function for stability. If the position of the poles indicate entrainment, the processor determines and implements a change to the adaptation rate of the system.

Figure 1:
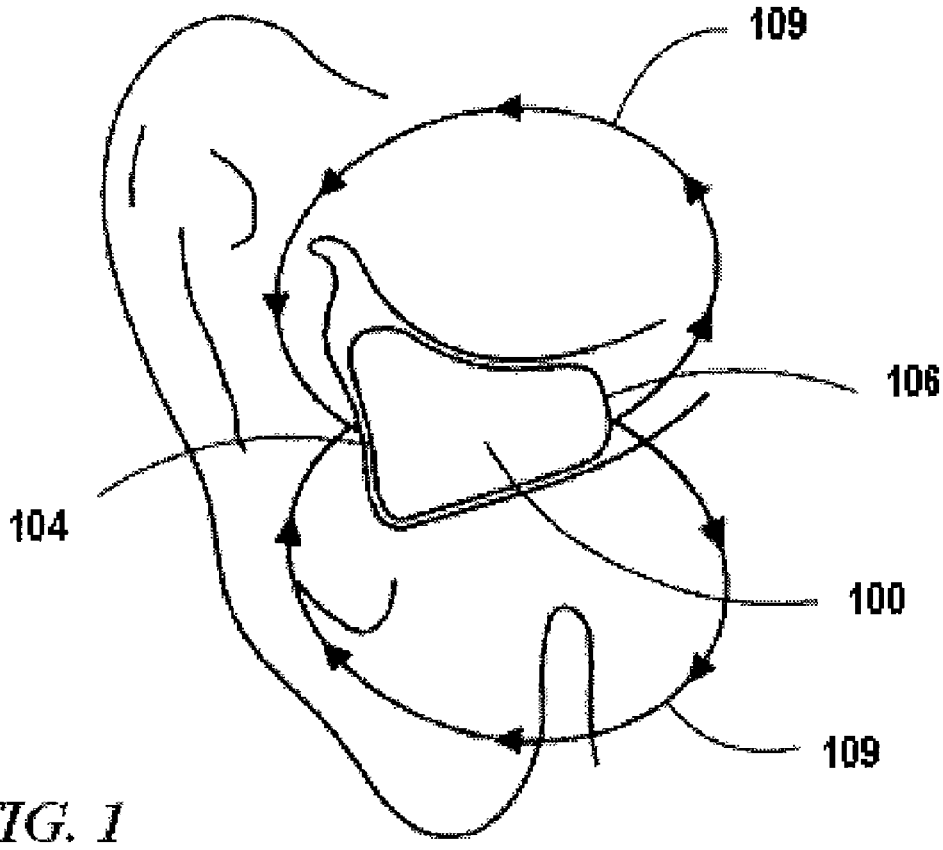
FIG. 1 is a diagram demonstrating, for example, an acoustic feedback path for one application of the present system relating to an in the ear hearing aid application, according to one application of the present system.

FIG. 1 is a diagram demonstrating, for example, an acoustic feedback path for one application of the present system relating to an in-the-ear hearing aid application, according to one embodiment of the present system. In this example, a hearing aid 100 includes a microphone 104 and a receiver 106. The sounds picked up by microphone 104 are processed and transmitted as audio signals by receiver 106. The hearing aid has an acoustic feedback path 109 which provides audio from the receiver 106 to the microphone 104.

Figure 2:
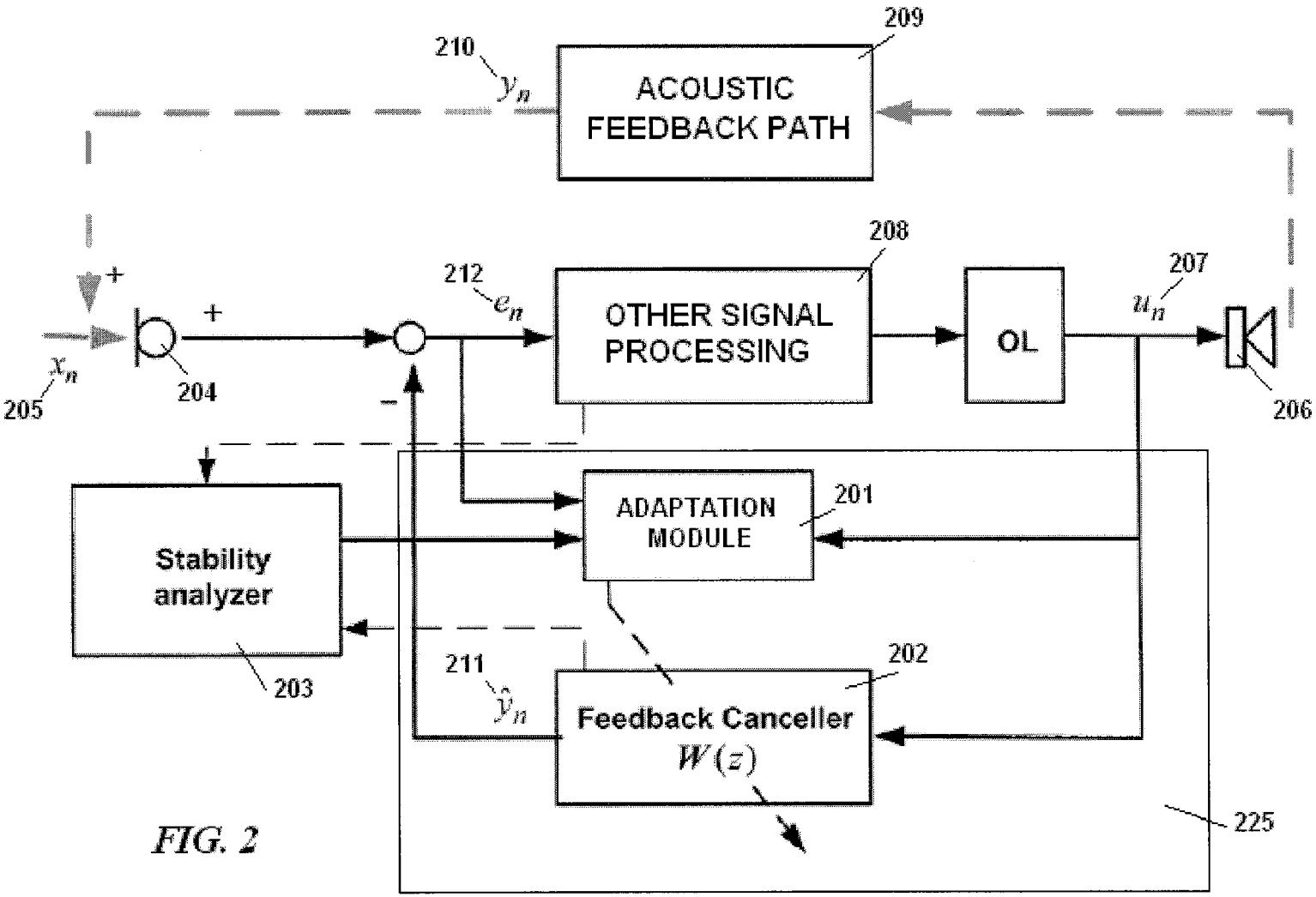
FIG. 2 illustrates an acoustic system with an adaptive feedback cancellation filter according to one embodiment of the present subject matter.

FIG. 2 illustrates an acoustic system 200 with an adaptive feedback cancellation filter 225 according to one embodiment of the present subject matter. The embodiment of FIG. 2 also includes a input device 204, such as a microphone, an output device 206, such as a speaker, processing electronics 208 for processing and amplifying a compensated input signal $e_n$ 212, and an acoustic feedback path 209 with acoustic feedback path signal $y_n$ 210. In various embodiments, the adaptive feedback cancellation filter 225 mirrors the feedback path 209 transfer function and signal $y_n$ 210 to produce a feedback cancellation signal $\hat{y}_n$ 211. When $\hat{y}_n$ 211 is subtracted from the input signal $x_n$ 205, the resulting compensated input signal $e_n$ 212 contains minimal, if any, feedback path 209 components. In various embodiments, the feedback cancellation filter 225 includes an adaptive filter 202 and an adaptation module 201. The adaptation module 201 adjusts the coefficients of the adaptive filter to minimize the error between the desired output and the actual output of the system. In one embodiment, a stability analyzer portion is used for analyzing stability of the adaptive feedback cancellation filter 225 for indication of entrainment. In other examples, the adaptive feedback cancellation filter 225 includes a stability analyzer portion for analyzing stability of the adaptive filter canceller for indication of entrainment. In various embodiments, the stability analyzer module processing is adapted to process independent of the adaptive feedback cancellation filter.

Figure 3A:
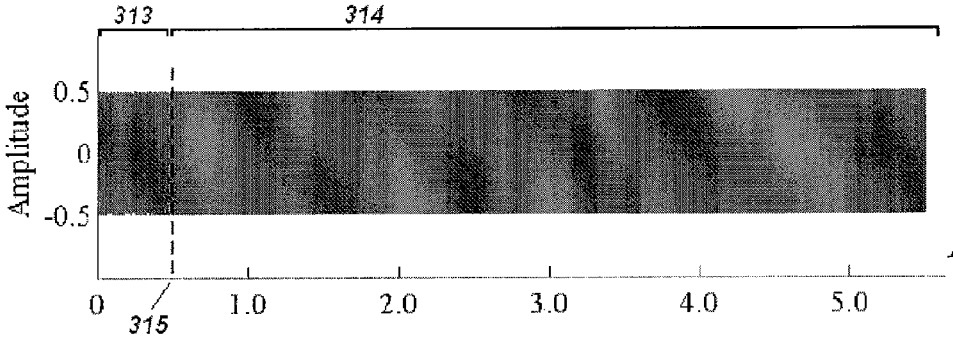
FIGS. 3A to 3C illustrate the response of an adaptive feedback system with using a stability analyzer processing module according one embodiment of the present subject matter, but without modulating the adaptation of the adaptation module in light of indicated entrainment.
Figure 3B:
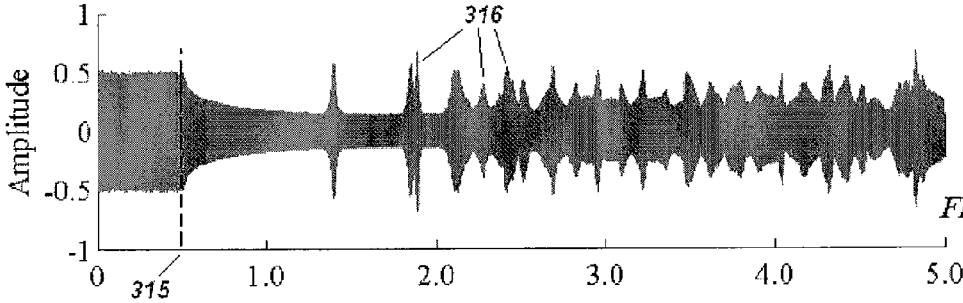
Figure 3C:
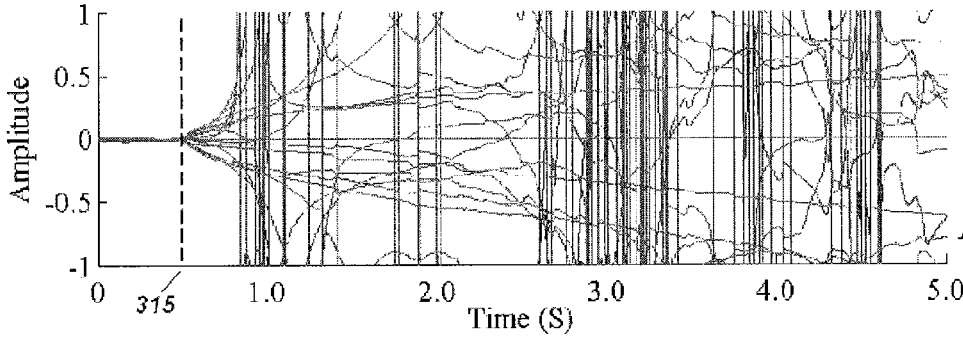

FIGS. 3A-3C illustrate the response of an adaptive feedback system with using a stability analyzer processing module according one embodiment of the present subject matter, but without modulating the adaptation of the adaptation module in light of indicated entrainment. The input to the system includes a interval of white noise 313 followed by interval of tonal input 314 as illustrated in FIG. 3A. FIG. 3B illustrates the output of the system in response to the input signal of FIG. 3A. As expected, the system's output tracks the white noise input signal during the initial interval 313. When the input signal changes to a tonal signal at 315, FIG. 3B shows the system is able to output an attenuated signal for a short duration before the adaptive feedback filter begins to entrain to the tone and pass entrainment artifacts 316 to the output. The entrainment artifacts are illustrated by the periodic amplitude swings in the output response of FIG. 3B. FIG. 3C shows a representation of reflection coefficients of the adaptive filter during application of the input signal of FIG. 3A. During the white noise interval the reflection coefficient maintained a narrow range of values compared to the reflection coefficient values during the tonal interval of the input signal.

In general, the present subject matter achieves entrainment avoidance by transforming the denominator of the system transfer function to lattice form and monitoring the reflection coefficients for indication of entrainment. Entrainment is probable where the reflection coefficients approach unity stability.

The feedback canceller system of equations can be transformed to control canonical form and apply the Lyapunov stability as shown below, $$C(z) = \frac{G(z)}{1 - G(z)(F_0(z) - W(z))}$$

$$\begin{pmatrix} x(n+1) \\ x(n+2) \\ \vdots \\ x(m+k) \end{pmatrix} = \begin{pmatrix} 0 & 1 & \cdots & 0 \\ \vdots & \cdots & \cdots & \cdots \\ 0 & \cdots & 0 & 1 \\ gv_{m+k-1} & \cdots & gv_1 & gv_0 \end{pmatrix} \begin{pmatrix} x(n) \\ x(n+1) \\ \vdots \\ x(m+k-1) \end{pmatrix} + \begin{pmatrix} 0 \\ 0 \\ \vdots \\ 1 \end{pmatrix} u_n$$

-continued $$y_n = (0 \quad 0 \quad \cdots \quad 1) \begin{pmatrix} x(n) \\ x(n+1) \\ \vdots \\ x(m+k-1) \end{pmatrix}$$

The stability of a time linear system of $$x_{k+1} = Ax_k + Bu_k \; k=0, 1, 2, \ldots$$

is determined using Lyapunov function, where A is the linear system matrix and x is the input matrix.

$$V(x) = x^T Qx,$$

where V(x) is the Lyapunov function. If the derivative, ΔV(x), is positive near the neighborhood of interest, the system is stable in that neighborhood. x denote the real vector of dimension n, A and Q are quadratic matrices. The derivative of V(x) with respect to time is give by $$\begin{aligned} \Delta V(x) &= V(x_{k+1}) - V(x_k) \\ &= x^T(A^T QA - Q)x \\ &= x^T Sx. \end{aligned}$$

From above, $$A^T QA - Q = -S.$$

This equation has exactly one solution for any given matrix, if $Q=Q^T$ is positive definite, being denoted by Q>1, if and only if the relation, $$\alpha_i^* \alpha_j \neq 1 \text{ and } \alpha_i \neq 1 \; i=0, 1, 2, \ldots$$

hold for all eigenvalues $\alpha_i$ of A.

From the equations above, for a positive definite Q matrix, the eigenvalues of the system B are inside the unit circle of stability. It is known that the solution to discrete time Lyapunov function is the same as looking into a Schur polynomial solution in order reverse form.

The Schur-Cohn stability test has the property of being a recursive algorithm. This is a consequence of the simultaneously algebraic and analytic aspect of the Schur coefficients, which are regarded as reflection coefficients. The denominator polynomial is converted to lattice form with reflection coefficients using Schur polynomials. The reflection coefficient magnitudes are used to evaluate the stability of the system.

The lattice structures with reflection coefficients $K_1$, $K_2 \ldots K_m$ correspond to a class of m direct-form FIR filters with system functions $D_1(z), D_2(z), \ldots D_m(z)$. Given the D(z) matrix, the corresponding lattice filter parameters $\{K_m\}$ are determined. For the m stage lattice system, the initial parameter $K_m = d_m$. $K_{m-1}$ is obtained from the polynomials $D_{m-1}(z)$ since $K_m$ is obtained from the polynomial $D_m(z)$ for m=M−1, M−2, . . . , 1. The lattice filter parameters $K_m$'s are computed recursively starting from m=M−1 to m=1 as, $$\begin{aligned} D_m(z) &= D_{m-1}(z) + K_m z^{-1} B_{m-1}(z) \\ &= D_{m-1}(z) + K_m[B_m(z) - K_m D_{m-1}(z)] \end{aligned}$$

where $$B_m(z) = z^{-m} D_m(z^{-1}).$$

The above equation can be simplified to $$D_{m-1}(z) = \frac{D_m(z) - K_m B_m(z)}{1 - K_m^2}$$

$$m = (M-1), (M-2), \ldots, 1.$$

The above recursion is known as the Schur-Cohen stability test. In doing that we compute the lower degree polynomials. The procedure works as long as Km 6=1 for m=1, 2, . . . , (M−1). Let denominator polynomials be D(z), $$D(z)=1-G(z)(F_0(z)-W(z)),$$

$$\begin{aligned} D(z) &= 1 + g(f_0 - w_0)z^{-1-M+1} + g(f_1 - w_1)z^{-1-M+2} + \\ &\quad g(f_1 - w_1)z^{-1-M+2} + \ldots + g(f_{m-1} - w_{m-1})z^{-k} \\ &= d_0 + d_1 z^1 + \ldots + d_{M-1} z^{M-1} + z^{k+M-1}, \end{aligned}$$

where k is the system delay and M is the number of taps of the feedback canceller.

If poles move outside the unit circle due to instability a new frequency is created. In order to avoid the poles reaching unit circle or stability boundary, In various embodiments, a pseudo unit circle, which is smaller than unit circle, is used for analyzing the stability. Prior to the analyzing the denominator polynomial, D(z) is scaled by a factor. The scaling the polynomial is with, $$\tilde{d}_i = d_i * \rho^i \text{ for } i=0, 1, 2, \ldots, (M+K-1),$$

where ρ>1 is a scaling factor which is chosen between 1.01 and 1.05 to arrive at the pseudo circle.

Entrainment avoidance is achieved using the signal processor to analyze the denominator polynomial for stability and changing the adaptation rate of the system depending on the position of the poles. The analysis algorithm includes stages to initialize the feedback canceller, generate future pole positions, analyze the stability of the future pole positions with respect to a pseudo stability circle and adjust the adaptation rate of the feedback canceller in light of the analysis.

Initializing the feedback controller establishes a good estimate of the feedback path, $F_0(z)$. A good estimate of the leakage path, $F_0(z)$ is necessary to generate the denominator polynomial, D(z). In various embodiments, a good estimate can be found by a forward gain module disconnected white noise initialization, where the system gets simplified to a system identification configuration. The is known to accurately estimate $F_0(z)$. In various embodiments, a good estimate of $F_0(z)$ is achieved by copying the $W_n(z)$ coefficients to $F_0(z)$ at a point where the feedback canceller is modeling the feedback path. In order to identify a suitable time for copying the coefficients, the convergence accuracy can be analyzed by monitoring the average $e_n$ values.

Once the denominator polynomial is constructed, the denominator is scaled by multiplications of the denominator as shown above. The scaled denominator is used to identify the pole position of the system at a future iteration.

In various embodiments, the future pole position is converted to Lattice form to evaluate stability. This can be viewed as comparing the poles against a pseudo unit circle described above. Use of the pseudo circle is important since once the poles of the system moves outside the stable region, regaining stability of the system is difficult.

In various embodiments, if the poles move outside the pseudo circle and a update of the filter coefficients is to take place, we stop adaptation by not updating the filter. In some situations if the adaptation is constantly trying to move out of the unit circle in a predictable manner it is possible to reverse the update. This can be viewed as a negative adaptation and can be useful in some situations. If adaptation is stopped for some random movement of a pole outside the circle as the pole returns the adaptation will continue to regain the stability.

By using the Schur polynomials the pole space is translated into the reflection coefficient space. This method is used in time-varying IIR filters. Lattice structure is used to ensure stability of the system without identifying the roots of a system transfer function. If one or more reflection coefficients are larger than one, the system is unstable. For electro-acoustic systems, it is reasonable to conclude that the entrainment is the main driving force of the poles outside the unit circle. An alternate method of combating entrainment includes reversing the adaptation process. This method does bring the system back to stability due to the stochastic nature of the NLMS algorithm, where stopping the system from adapting, reduces the ability of the system to recover from some adverse entrainment conditions.

The following complexity calculation is for comparison with the standards NLMS feedback canceller algorithm for the canceller path. Even though the algorithm is significantly more complex, the performance of this algorithm is similar to the standard NLMS algorithm when the system poles are inside the unit circle. Where M is the number of NLMS filter taps and D is length of the denominator polynomial which depends on the effective feedback leakage path (identified during the initialization phase). Assuming the denominator length to be same as the feedback canceller length for simplicity, the pole stabilizing algorithm totals to ~6M complex and 7M simple operations. This is comparatively expensive than the ~3M complex and 4M simple operations for standard NLMS feedback canceller algorithms. This algorithm can be decimated to reduce the complexity.

Figure 4A:
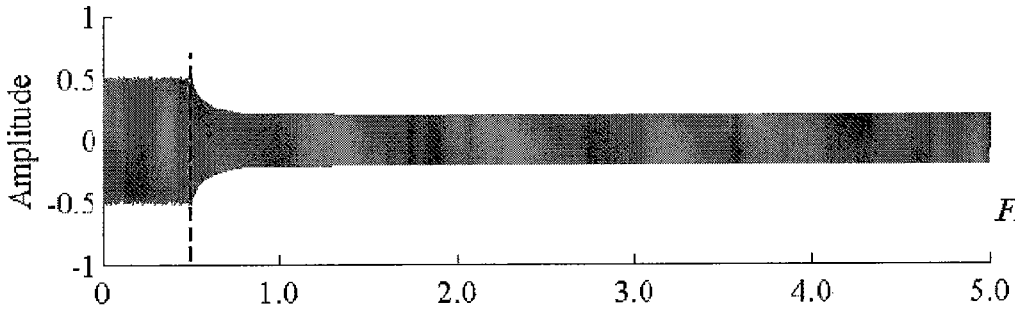
FIG. 4A shows a system, according to one embodiment of the present subject matter, outputting an interval of white noise followed by an interval of tonal signal closely replicating the input to the system represented by the signal illustrated in FIG. 3A.
Figure 4B:
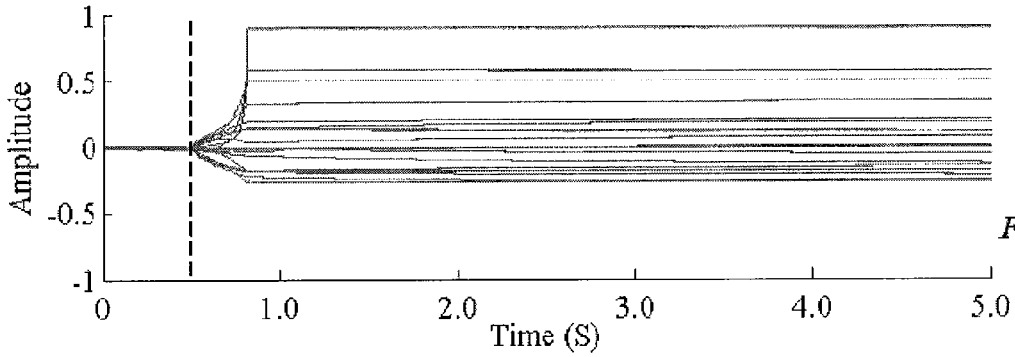
FIG. 4B illustrates a representation of reflection coefficients derived from the anticipated pole positions based on the inputs of FIG. 4A.

FIG. 4A illustrates the response of the entrainment avoidance system embodiment of FIG. 2 using a stability analyzer module of a signal processor to monitor and modulate the adaptation of an adaptive feedback cancellation filter. The stability analyzer module is adapted to determine future pole positions of the denominator of the system transfer function, convert the future pole positions to lattice form, apply a Schur-Cohn stability test and monitor the values of the derived reflection coefficients for indication of entrainment. FIG. 4A shows the system outputting an interval of white noise followed by an interval of tonal signal closely replicating the input to the system represented by the signal illustrated in FIG. 3A. FIG. 4B illustrates a representation of reflection coefficients derived from the anticipated pole positions. FIG. 4B shows, during the tonal input period, the values of the reflection coefficients do spread from the values measured during the white noise interval. However, because the stability analyzer module modulates the adaptation of the adaptive feedback cancellation filter, the reflection coefficients do not fluctuate and diverge as extremely as in the FIG. 3C. As a result, FIG. 4A does not show entrainment peaks as entrainment artifacts are eliminated using the various embodiments of the present application subject matter. However, FIG. 4B does show attenuation of the tonal input. Tonal input signal attenuation is frequency dependent and for some frequencies, attenuation will also be adaptation rate dependent. The results of FIGS. 4A-B were generated with a typical acoustic leakage path (22 tap) with a 16 tap DCT-LMS adaptive feedback canceller with eigenvalue control. Each data point is created by averaging 20 runs (N=20). Each audio file is 10 seconds in duration, 5 seconds of white noise followed by 5 seconds of tonal signal.

Figure 5:
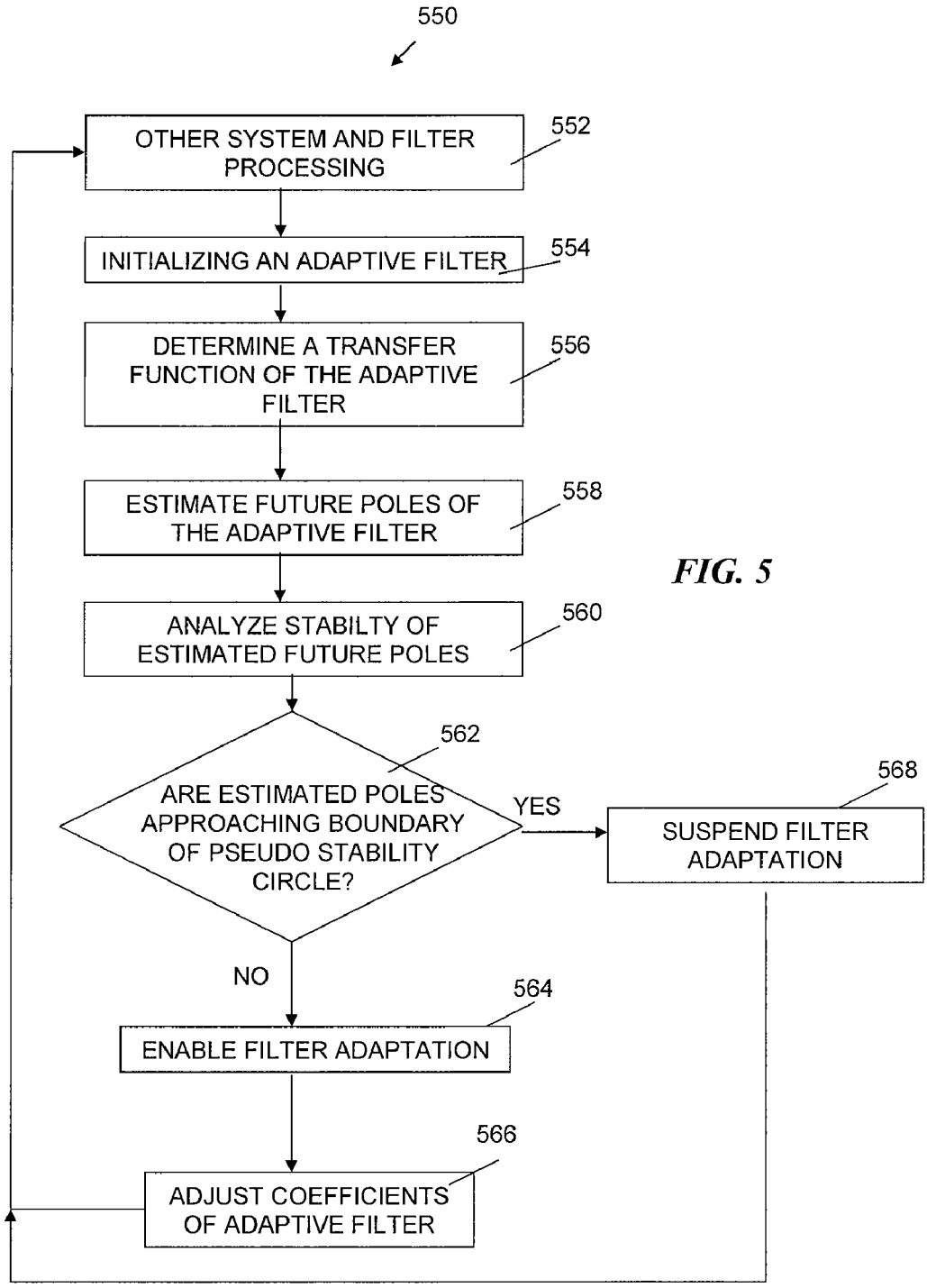
FIG. 5 is a flow diagram showing an example of a method of entrainment avoidance according to one embodiment of the present subject matter.

FIG. 5 is a flow diagram showing an example of a method of entrainment avoidance 550 according to one embodiment of the present subject matter. In the illustrated embodiment, various systems perform signal processing 552 associated with amplification and feedback cancellation while monitoring and avoiding entrainment of an adaptive feedback cancellation filter. In various embodiments the filter is initialized 554. Initialization 554 can be accomplished by a forward gain module disconnected white noise initialization, where the system gets simplified to a system identification configuration. The transfer function of the system is determined 556 such that stability of the filter can be analyzed for indications of entrainment. Once the transfer function is determined, an estimate of the pole positions made 558 and analyzed against a pseudo circle for stability 560. If the poles are not near or approaching the pseudo circle 562, adaptation of the adaptive filter is enabled 564 and the coefficients of the adaptive filter are updated 566. If the poles of are near the boundary, or approaching the boundary of the pseudo circle, an indication of entrainment of the adaptive filter, adaptation of the adaptive filter is suspended 568 until the filter stabilizes. It is understood that some variation in order and acts being performed are possible without departing from the scope of the present subject matter.

It is understood that the foregoing teachings may be employed in different hardware, firmware, or software configurations and combinations thereof. It is understood that the embodiments set forth herein may be employed in different devices, including, hearing assistance devices, such as hearing aids. Such hearing aids may include, but are not limited to, behind-the-ear, in-the-ear, and completely-in-the-canal designs. Other applications of the foregoing teachings are possible without departing from the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. An apparatus, comprising:

a microphone;

signal processing electronics receiving signals from the microphone, the signal processing electronics including:

an adaptive acoustic feedback cancellation filter for reduction of acoustic feedback, the acoustic feedback cancellation filter including an adaptation module and an adaptive filter; and a stability analyzer module;

a receiver receiving signals from the signal processing electronics, wherein the stability analyzer module is configured to analyze stability of the adaptive filter and control adaptation rate of the adaptive filter for avoidance of entrainment artifacts using a result of the analysis; and wherein the stability analyzer module is configured to: generate one or more estimated future pole positions of a transfer function of the adaptive filter; analyze the one or more estimated future pole positions for an indication of entrainment; and adjust the adaptation rate of the adaptive filter using the one or more estimated future pole positions.

2. The apparatus of claim 1, wherein the stability analyzer module is configured to: convert the one or more estimated future pole positions to lattice form; apply a Schur-Cohn stability test to derive reflection coefficients of the adaptive filter using the one or more estimated future pole positions; and monitor values of the derived reflection coefficients for the indication of entrainment.

3. The apparatus of claim 2, wherein the signal processing electronics include a digital signal processor.

4. The apparatus of claim 1, wherein the apparatus includes a housing configured to be worn behind-the-ear.

5. The apparatus of claim 1, wherein the apparatus includes a housing configured to be worn in-the-ear.

6. The apparatus of claim 1, wherein the apparatus includes a housing configured to be worn completely-in-the-canal.

7. The apparatus of claim 1, wherein the signal processing electronics include a digital signal processor.

8. The apparatus of claim 1, wherein the signal processing electronics include digital signal processor.

9. The apparatus of claim 1, wherein the stability analyzer module is a function performed by a digital signal processor executing instructions.

* * * * *